US011196169B2

(12) United States Patent
Shen et al.

(10) Patent No.: US 11,196,169 B2
(45) Date of Patent: Dec. 7, 2021

(54) PRINTED CIRCUIT BOARD ANTENNA

(71) Applicant: AAC Technologies Pte. Ltd., Singapore (SG)

(72) Inventors: Yachuan Shen, Shenzhen (CN); Lei Zheng, Shenzhen (CN); Yongsheng Peng, Shenzhen (CN); Hongjun Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/945,945

(22) Filed: Aug. 3, 2020

(65) Prior Publication Data

US 2021/0021047 A1 Jan. 21, 2021

Related U.S. Application Data

(63) Continuation of application No. PCT/CN2019/093502, filed on Jun. 28, 2019.

(51) Int. Cl.

| | |
|---|---|
| ***H01Q 1/38*** | (2006.01) |
| ***H01Q 13/10*** | (2006.01) |
| ***H01Q 21/30*** | (2006.01) |
| *H01Q 1/24* | (2006.01) |

(52) U.S. Cl.

CPC ..... *H01Q 13/10* (2013.01); *H01Q 1/38* (2013.01); *H01Q 21/30* (2013.01); *H01Q 1/241* (2013.01)

(58) Field of Classification Search

CPC ..... H01Q 13/10; H01Q 1/38; H01Q 21/30
USPC ..... 343/767
See application file for complete search history.

(56) References Cited

U.S. PATENT DOCUMENTS

2020/0350672 A1* 11/2020 Chen ..... H01Q 9/285
2020/0366003 A1* 11/2020 Kim ..... H01Q 21/28

* cited by examiner

*Primary Examiner* — Peguy Jean Pierre
(74) *Attorney, Agent, or Firm* — W&G Law Group

(57) ABSTRACT

Provided is a PCB antenna, including PCB substrate, first and second radiating portions, the first radiating portion includes first radiator, second and third radiators extending therefrom to form feeding groove; the second radiating portion includes fourth radiator, fifth and sixth radiators extending therefrom, seventh radiator, eighth and ninth radiators extending therefrom, and tenth and eleventh radiators symmetrically arranged, the fifth radiator extends to the feeding groove; the sixth radiator extends in opposite direction of the fifth radiator; the seventh radiator extends in the direction of the sixth radiator and forms second slot therewith; the eighth radiator extends in opposite direction of the seventh radiator; third slot is formed between the tenth radiator and the second radiator, fourth slot is formed between the eleventh radiator and the third radiator. The PCB antenna provided can enhance medium and high frequency resonance and provide full-band omnidirectional antenna design under 4G demand.

12 Claims, 9 Drawing Sheets

PRINTED CIRCUIT BOARD ANTENNA

TECHNICAL FIELD

The present invention relates to the field of communication technology and, in particular, to a Printed circuit Board antenna.

BACKGROUND

With the continuous development of computer technology and communication technology, a variety of customer premise equipment (CPE) has appeared in consumers' daily life, and coverage of functions thereof is becoming more and more comprehensive. With the continuous universalization of the functions, consumers' demands for communication are also increasing, for example, demands for antenna performances are increasing. In the related technical solutions, a frequency band of the antenna that can be used for terminal device such as a CPE or a router is narrow, and it is only suitable for antenna demands in one certain frequency band. However, in practical applications, the related terminal device has a very urgent demand for a full-frequency band omnidirectional antenna under frequency band of 4G.

That is to say, in the related technical solutions, there is a lack of full-frequency band omnidirectional antennas in the frequency band of 4G to meet users' antenna requirements on terminal equipment such as the CPE and the router.

Therefore, it is necessary to design a full-frequency band omnidirectional antenna in the frequency band of 4G.

SUMMARY

An object of the present invention is to provide a PCB antenna to meet the full-frequency band omnidirectional antenna requirements in the frequency band of 4G.

The technical solution of the present invention is as follows:

A PCB antenna, including a PCB substrate, a first radiating portion and a second radiating portion that are provided on the PCB substrate;

the first radiating portion includes a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator;

the second radiating portion includes a fourth radiator, a fifth radiator extending from the fourth radiator and a sixth radiator extending from the fourth radiator, the fifth radiator extends to the feeding groove, and a first slot is formed between the fifth radiator and the first radiator; and the sixth radiator extends in a direction opposite to a direction in which the fifth radiator extends;

the second radiating portion further includes a seventh radiator, and an eighth radiator extending from the seventh radiator and a ninth radiator extending from the seventh radiator, and the seventh radiator extends in the direction in which the sixth radiator extends, and a second slot is formed between the seventh radiator and the sixth radiator; and the eighth radiator extends in a direction opposite to the direction in which the seventh radiator extends;

the second radiating portion further includes a tenth radiator and an eleventh radiator that respectively extend from a side of the fourth radiator and beyond the seventh radiator and are symmetrically arranged with respect to the axis of the first radiator in the first direction, the tenth radiator and the eleventh radiator further extend in a direction opposite to the first direction and beyond the fourth radiator, and the tenth radiator and the eleventh radiator are connected to the fourth radiator and the seventh radiator, respectively; and a third slot is formed between the tenth radiator and the second radiator, and a fourth slot is formed between the eleventh radiator and the third radiator.

As an improvement, a width of the third slot and a width of the fourth slot both range from 1.1 mm to 1.5 mm.

As an improvement, operating frequency bands of the first radiator and the tenth radiator are 790 MHz-960 MHz, and operating frequency bands of the third radiator and the eighth radiator are 1710 MHz-2690 MHz.

As an improvement, the tenth radiator is provided with a first opening at a side close to the fifth radiator, the first opening facing towards the sixth radiator, and the eleventh radiator is provided with a second opening at a side close to the fifth radiator, the second opening facing towards the sixth radiator, and a third opening is provided at a side of the tenth radiator facing away from the seventh radiator and a fourth opening is provided at a side of the eleventh radiator facing away from the seventh radiator.

As an improvement, the antenna further includes a feeder port provided in the first slot.

As an improvement, the feeder port includes one end connected to the first radiator and the other end connected to the fifth radiator.

As an improvement, the feeder port is a coaxial feeder port.

As an improvement, the PCB substrate has a size of 124.65 mm×27.02 mm and a thickness of 0.8 mm.

As an improvement, a slot width of the first slot is 2.25 mm, and a dimension of the fifth radiator in a direction perpendicular to the first direction is 1 mm; widths of the first opening and the second opening are both 3 mm; and widths of the third opening and the fourth opening are both 8 mm.

As an improvement, a dimension of the fifth radiator in a direction perpendicular to the first direction is smaller than a dimension of the sixth radiator in the direction perpendicular to the first direction, and a dimension of the fourth radiator in the first direction is larger than a dimension of the seventh radiator in the first direction.

The beneficial effects of the present invention lie in:

The PCB antenna provided by the embodiments of the present invention includes a PCB substrate, a first radiating portion and a second radiating portion that are provided on the PCB substrate; the first radiating portion includes a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator; the second radiating portion includes a fourth radiator, a fifth radiator extending from the fourth radiator and a sixth radiator extending from the fourth radiator, the fifth radiator extends to the feeding groove, and a first slot is formed between the fifth radiator and the first radiator; and the sixth radiator extends in a direction opposite to a direction in which the fifth radiator extends; the second radiating portion further includes a seventh radiator, and an eighth radiator extending from the seventh radiator and a ninth radiator extending from the seventh radiator, and the seventh radiator extends in the direction in which the sixth radiator extends, and a second slot is formed between the seventh radiator and the sixth radiator; and the eighth radiator extends in a direction opposite to the direction in which the seventh radiator extends; the second radiating portion further includes a tenth radiator and an eleventh radiator that respectively extend from a side of the fourth radiator and beyond the seventh radiator and are symmetrically arranged with respect to the axis of the first radiator in the first direction, the tenth radiator and the eleventh radiator further extend in a direction opposite to the first direction and beyond the fourth radiator, and the tenth radiator and the eleventh radiator are connected to the fourth radiator and the seventh radiator, respectively; and a third slot is formed between the tenth radiator and the second radiator, and a fourth slot is formed between the eleventh radiator and the third radiator.

Adopting the PCB antenna provided by the present invention, signal radiation of multiple frequency bands under the frequency band of 4G can be achieved through the radiation between the plurality of radiators, adopting horizontal or vertical radiator arrangement and slots and grooves when arranging the radiators improves the convenience of the PCB antenna in the processing process, and adopting the compact structure arrangement reduces the overall dimension of the PCB antenna and reduces demand for an antenna area. In addition, coupling is carried out by the slot sizes of the third slot and the fourth slot, to enhance the resonance performance of the PCB antenna at medium and high frequencies, improve the antenna performance, and realize the signal radiation in multiple frequency bands under the frequency band of 4G.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will be further illustrated with reference to the accompanying drawings and the embodiments.

In the present invention, a PCB antenna is provided. The antenna has a multi-band function and can realize signal radiation in frequency bands of 790-960 MHz and 1710-2690 MHz under the frequency band of 4G.

Referring to FIGS. 1-4, a schematic diagram of a PCB antenna is shown.

The PCB antenna 10 includes a PCB substrate 11, and a first radiating portion 100 and a second radiating portion 200 that are provided on the PCB substrate 11.

Figure 1:
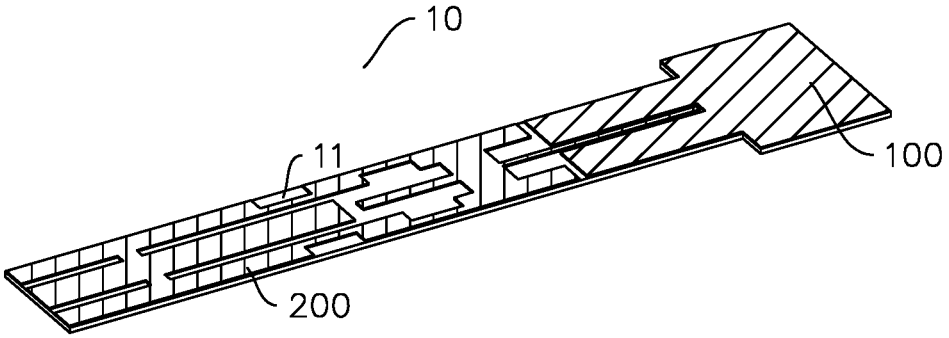
FIG. 1 is a schematic perspective diagram of a PCB antenna according to an embodiment of the present invention.

In a preferred embodiment, as shown in FIG. 1, the PCB substrate 11 has a size of 124.65 mm×27.02 mm and a thickness of 0.8 mm. The PCB substrate has a small volume and occupies little space in a terminal device.

Further, the first radiating portion 100 and the second radiating portion 200 are arranged opposite to each other and not directly connected with a slot therebetween.

The first radiating portion 100 includes a first radiator 101, and a second radiator 102 and a third radiator 103 that extend from the first radiator 101. The second radiator 102 and the third radiator 103 are arranged symmetrically with respect to an axis 500 of the first radiator 101 in a first direction 401. A feeding groove 301 is formed between the second radiator 102 and the third radiator 103. The first direction 401 is an extending direction of the second radiator 102 relative to the first radiator 101.

For convenience of description, in the present invention, the first direction is set to a right-to-left direction in a horizontal direction, and a direction opposite to the first direction is a left-to-right direction in the horizontal direction.

Figure 2:
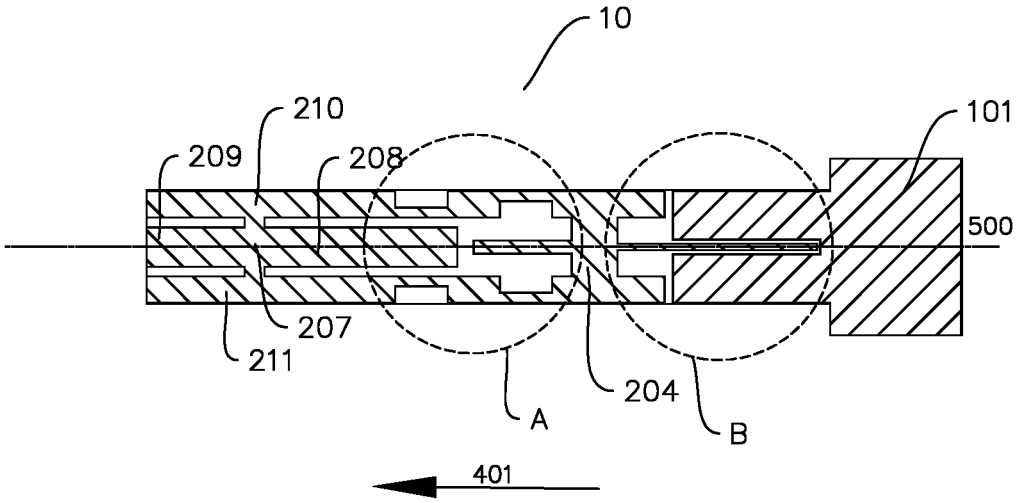
FIG. 2 is a schematic plan diagram of a PCB antenna according to an embodiment of the present invention.
Figure 3:
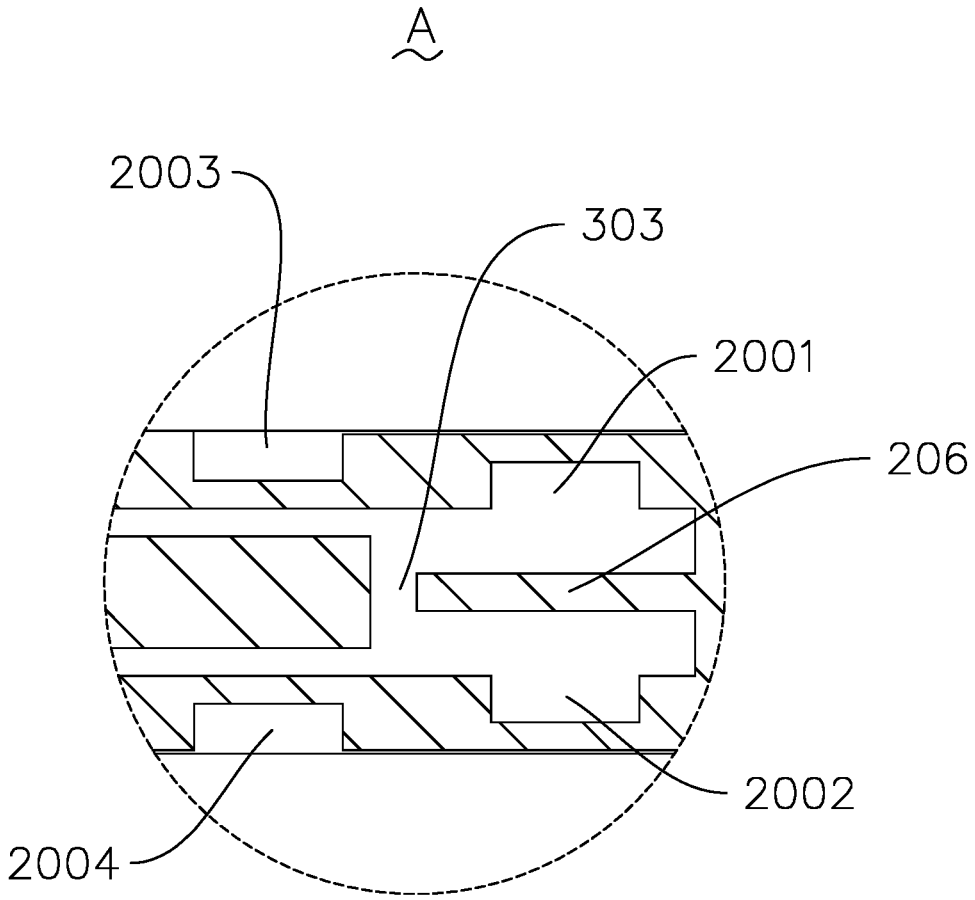
FIG. 3 is a partially enlarged schematic diagram of a PCB antenna according to an embodiment of the present invention.
Figure 4:
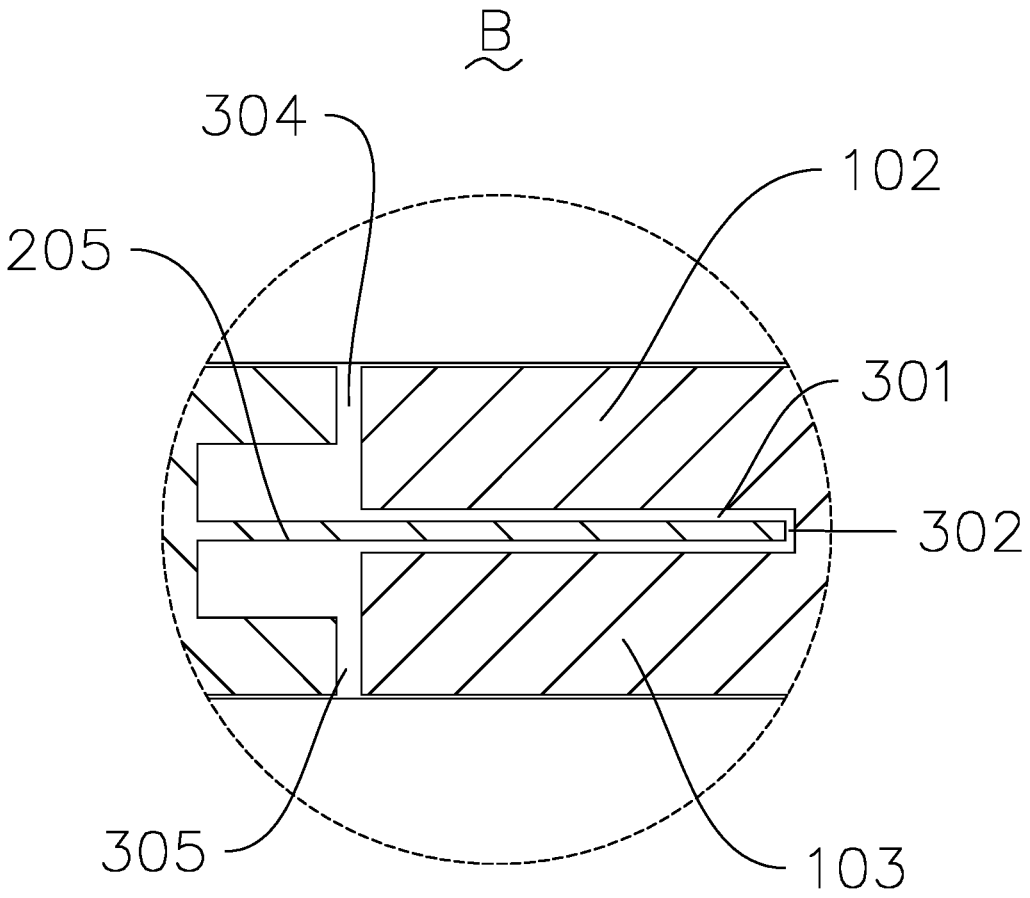
FIG. 4 is a partially enlarged schematic diagram of a PCB antenna according to an embodiment of the present invention.

That is, as shown in FIGS. 2-4, the second radiator 102 and the third radiator 103 are provided on a left side of the first radiator 101. The second radiator 102 and the third radiator 103 are formed by extending from the left side of the first radiator 101 and extending a certain length from right to left in the horizontal direction. The second radiator 102 and the third radiator 103 are symmetrically arranged with respect to the axis of the first radiator 101 in the horizontal direction and form a slot therebetween, and the slot is the feeding groove 301.

As shown in FIGS. 2-4, the second radiating portion 200 includes a fourth radiator 204, and a fifth radiator 205 and a sixth radiator 206 that extend from the fourth radiator 204 in the horizontal direction. The fifth radiator 205 extends rightward to the feeding groove 301 and forms a first slot 302 with the first radiator 101. The sixth radiator 206 extends leftward from the fourth radiator 204.

The second radiating portion 200 further includes a seventh radiator 207, and an eighth radiator 208 and a ninth radiator 209 that extend from the seventh radiator 207 in the horizontal direction. The seventh radiator 207 extends in a direction towards the sixth radiator 206 (that is, horizontally rightward) and forms a second slot 303 with the sixth radiator 206. The eighth radiator 208 extends in an opposite direction of the seventh radiator 207 (that is, horizontally leftward).

The second radiating portion 200 further includes a tenth radiator 210 and an eleventh radiator 211, which extend from the fourth radiator 207, exceed beyond the seventh radiator 207 and are symmetrically arranged with respect to the axis of the first radiator 101 in the horizontal direction. The tenth radiator 210 and the eleventh radiator 211 extend along a direction opposite to the first direction and exceed beyond the fourth radiator 204, and the tenth radiator 210 and the eleventh radiator 211 are both connected to the fourth radiator 204 and the seventh radiator 207. The tenth radiator 210 and the eleventh radiator 211 both extend leftward to a position of the ninth radiator 209, and left sides (a side facing away from the first radiating portion) of the tenth radiator 210 and the eleventh radiator 211 are aligned with a left side (the side facing away from the first radiating portion) of the ninth radiator 209. The tenth radiator 210 and the eleventh radiator 211 both extend rightward to exceed beyond a position of the fourth radiator 204 but not exceed beyond a position of the fifth radiator 205.

Moreover, the tenth radiator extends rightward to be close to the second radiator and forms a third slot 304 with the second radiator. The eleventh radiator extends rightward to be close to the third radiator and forms a fourth slot 305 with the third radiator 103. Further, in the present invention, in order to enhance resonance performance of the PCB antenna in medium and high frequency bands, a width of the third slot 304 and a dimension of the fourth slot 305 in the horizontal direction are both 1.1-1.5 mm. For example, a width of the third slot 304 and a dimension of the fourth slot 305 in the horizontal direction are both 1.3 mm, that is, a coupling distance between the first radiating portion 100 and the second radiating portion 200 may be set to 1.3 mm. Through a specific coupling distance, the resonance performance of the antenna in the medium and high frequency bands is enhanced, and the antenna performance is improved.

In another optional embodiment, referring to FIGS. 2-4, the tenth radiator 210 and the eleventh radiator 211 are respectively provided with a first opening 2001 and a second opening 2002 at sides close to the fifth radiator 205 and facing towards the sixth radiator 206, and the first opening 2001 and the second opening 2002 are arranged symmetrically with respect to the axis of the first radiator 101 in the horizontal direction. In addition, the tenth radiator 210 and the eleventh radiator 211 are respectively provided with a third opening 2003 and a fourth opening 2004 at sides facing away from the seventh radiator 207, and the third opening 2003 and the fourth opening 2004 are arranged symmetrically with respect to the axis of the first radiator 101 in the horizontal direction. The first opening 2001 and the third opening 2003 are provided on the tenth radiator, the second opening 2002 and the fourth opening 2004 are provided on the eleventh radiator. The first opening 2001 is on a right side of the third opening 2003, and the second opening 2002 is on a right side of the fourth opening 2004.

Further, in the horizontal direction, left sides (sides close to the third opening 2003 and the fourth opening 2004) of the first opening 2001 and the second opening 2002 are located on the right of a left side (a side facing away from the fourth radiator 204) of the sixth radiator 206.

That is to say, the radiators, openings, slots and grooves of the above PCB antenna are all arranged in the horizontal direction or in a vertical direction, and use of vertical slots and grooves can improve convenience and controllability during the processing of the PCB antenna. Moreover, the PCB antenna provided in the present invention has a compact structure, which can reduce requirements for the size of the PCB substrate, so as to ensure that the size of the PCB antenna is sufficiently small as a whole, thereby reducing space design requirements and volume design requirements on the antenna installed in the terminal device during application.

In a specific embodiment, the first radiator has a dimension of 20 mm in the horizontal direction and has a dimension of 27.02 mm or 17.02 mm in the vertical direction. That is to say, upper and lower sides of the first radiator 101 may be aligned with an upper side of the second radiator 102 and a lower side of the third radiator 103 and may be also exceed beyond the upper side of the second radiator 102 and the lower side of the third radiator 103, which can be specifically determined according to the size of the PCB substrate and a size of a spatial position where the PCB antenna is installed.

In an alternative embodiment, the second radiator 102 has a dimension of 7.38-7.39 mm in the vertical direction. The feeding groove 301 has dimension of 2.25 mm in the vertical direction. A slot width of the first slot 302 is 2.25 mm, and a dimension of the fifth radiator 205 in a direction perpendicular to the first direction is 1 mm.

A dimension of the fifth radiator 205 in the vertical direction is smaller than a dimension of the sixth radiator 206 in the vertical direction. The dimension of the fifth radiator 205 in the vertical direction and the dimension of the sixth radiator 206 in the vertical direction are smaller than dimensions of the eighth radiator 208 and the ninth radiator 209 in the vertical direction. A dimension of the fourth radiator 204 in the horizontal direction is larger than a dimension of the seventh radiator 207 in the horizontal direction. The dimension of the fourth radiator 204 in the horizontal direction is 3 mm. Dimensions of the tenth radiator 210 and the eleventh radiator 211 in the vertical direction are both 4 mm.

Dimensions of the first opening 2001 and the second opening 2002 in the horizontal direction are smaller than dimensions of the third opening 2003 and the fourth opening 2004 in the horizontal direction. The dimensions of the first opening 2001 and the second opening 2002 in the horizontal direction are both 3 mm in width. The dimensions of the third opening 2003 and the fourth opening 2004 in the horizontal direction are both 8 mm. The dimensions of the first opening 2001, the second opening 2002, the first opening 2003, and the second opening 2004 in the vertical direction are 2.5 mm.

In the present invention, the aforementioned PCB antenna 10 cooperates between the plurality of radiators included in the first radiating portion 100 and the plurality of radiators included in the second radiating portion 200, to at least coordinately realize resonance in the frequency band of 4G. Specifically, operating frequency bands of the first radiator 101 and the tenth radiator 210 are 790-960 MHz; operating frequency bands of the third radiator 103 and the eighth radiator 208 are 1710-2690 MHz. In other words, the PCB antenna 10 can at least achieve resonance in the frequency bands of 790-960 MHz and 1710-2690 MHz under the frequency band of 4G.

Further, the PCB antenna 10 further includes a feeder port 600 provided at the first slot 302. The feeding port 600 includes one end connected to the first radiator 101 and the other end connected to the fifth radiator 205, and a power-feeding manner of the feeder port 600 may be coaxial power-feeding.

Figure 5:
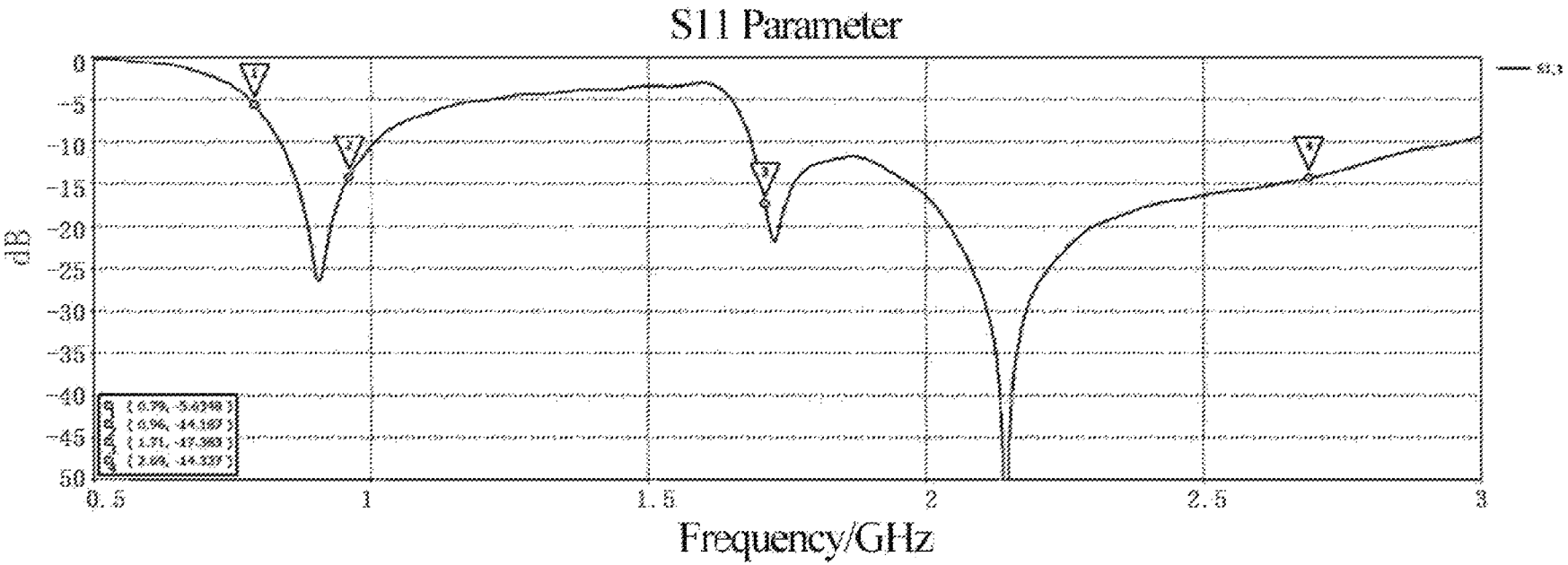
FIG. 5 shows a return loss curve of a PCB antenna during operation according to an embodiment of the present invention.
Figure 6:
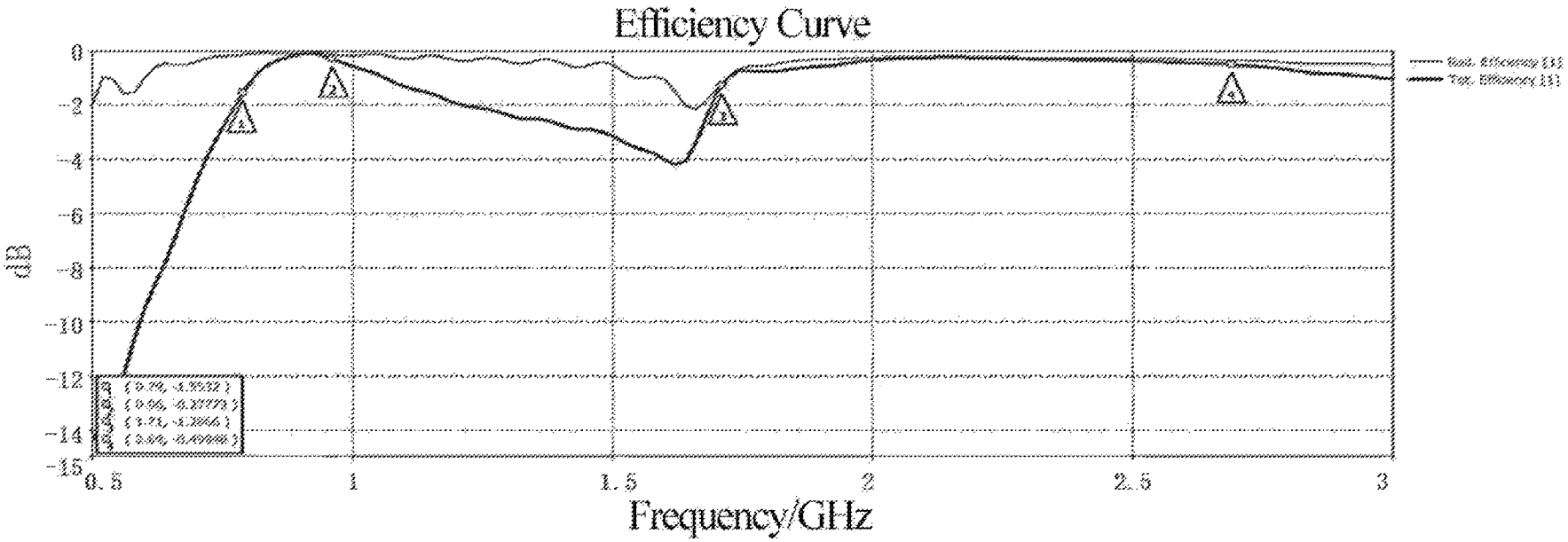
FIG. 6 shows an efficiency curve of a PCB antenna during operation according to an embodiment of the present invention.

As shown in FIG. 5 and FIG. 6, return loss and efficiency curve of the PCB antenna provided in the present invention during operation are given respectively.

Figure 7:
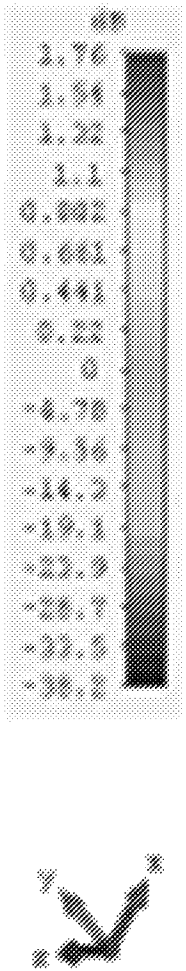
FIG. 7 shows a pattern of a PCB antenna at 900 MHz according to an embodiment of the present invention.
Figure 7:
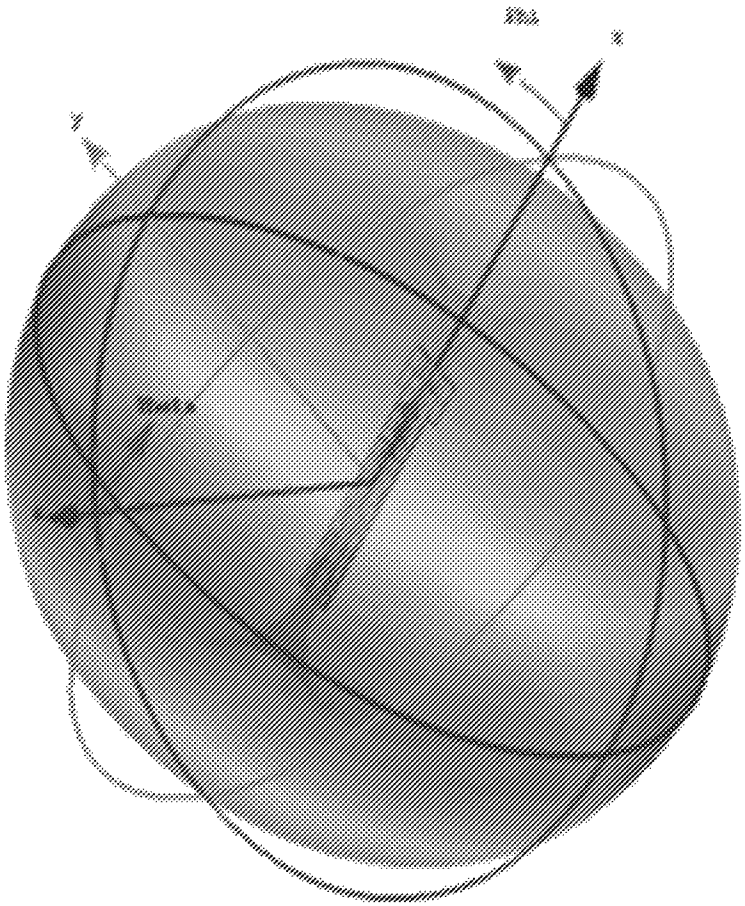
Figure 8:
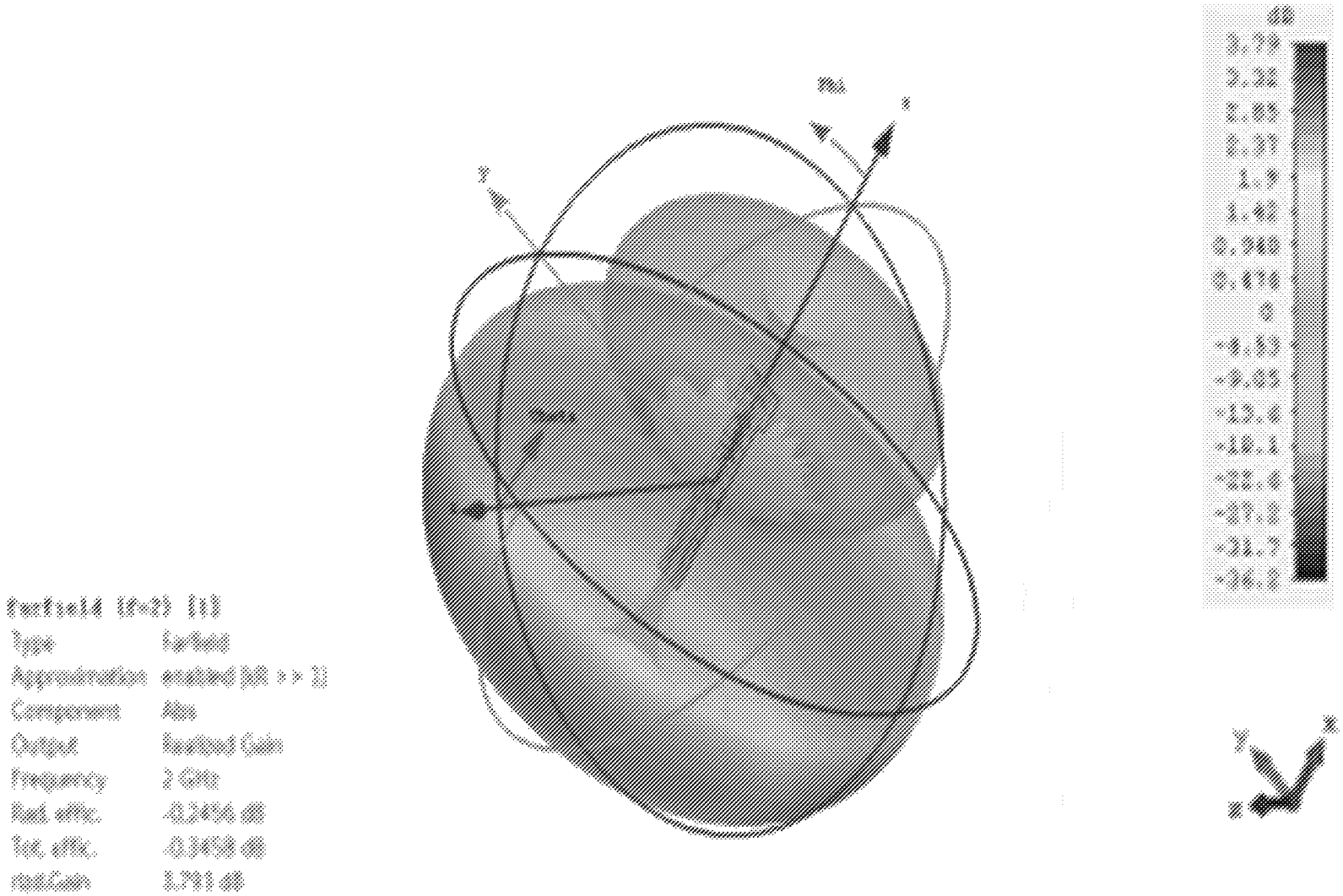
FIG. 8 shows a pattern of a PCB antenna at 2 GHz according to an embodiment of the present invention.
Figure 9:
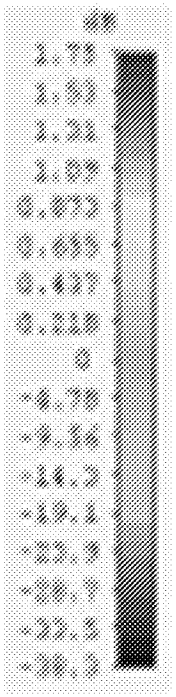
FIG. 9 shows a pattern of a PCB antenna at 2.6 GHz according to an embodiment of the present invention.
Figure 9:
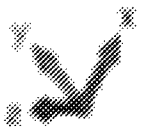
Figure 9:
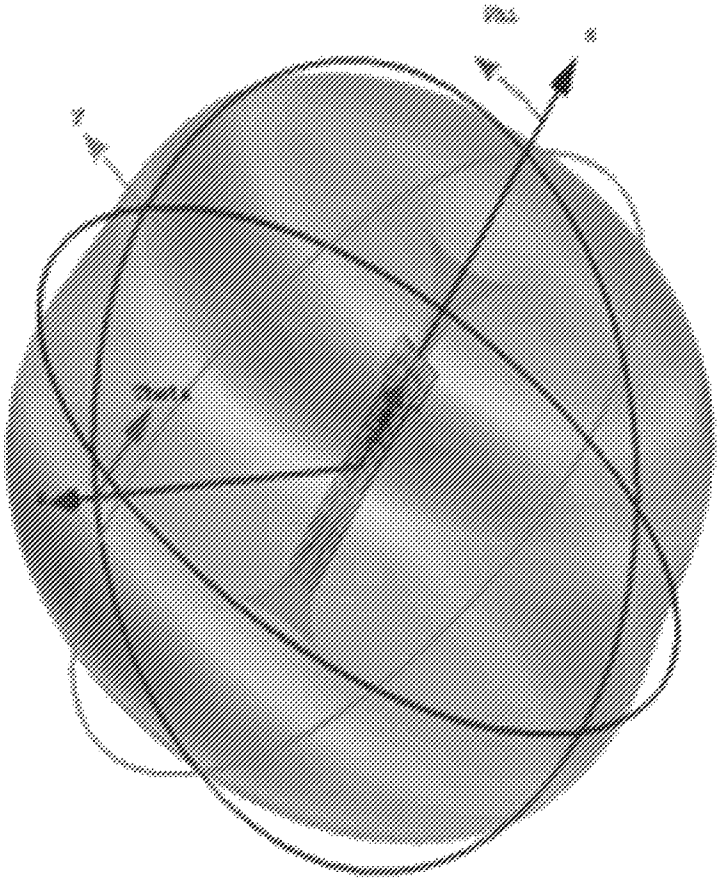
Figure 9:
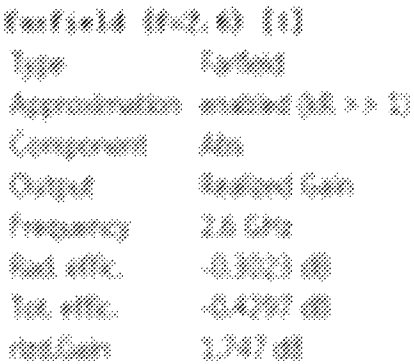

As shown in FIGS. 7-9, patterns of the PCB antennas provided in the present invention at frequencies of 900 MHz, 2.0 GHz and 2.6 GHz are given respectively.

Adopting the PCB antenna provided by the present invention, signal radiation of multiple frequency bands under the frequency band of 4G can be achieved through the radiation between the plurality of radiators, adopting horizontal or vertical radiator arrangement and slots and grooves when arranging the radiators improves the convenience of the PCB antenna in the processing process, and adopting the compact structure arrangement reduces the overall size of the PCB antenna and reduces demand for an antenna area. In addition, the slot coupling is carried out through the sizes of the third slot and the fourth slot, to enhance the resonance performance of the PCB antenna at medium and high frequencies, improve the antenna performance, and realize the signal radiation in multiple frequency bands under the frequency band of 4G.

It should be noted that, the above are merely embodiments of the present invention, those skilled in the art can make improvements without departing from the inventive concept of the present invention, however, these improvements shall belong to the protection scope of the present invention.

What is claimed is:

1. A Printed Circuit Board antenna, comprising:

a PCB substrate;

a first radiating portion provided on the PCB substrate; and a second radiating portion provided on the PCB substrate, wherein the first radiating portion comprises a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator;

the second radiating portion comprises a fourth radiator, a fifth radiator extending from the fourth radiator and a sixth radiator extending from the fourth radiator, the fifth radiator extends to the feeding groove, and a first slot is formed between the fifth radiator and the first radiator; and the sixth radiator extends in a direction opposite to a direction in which the fifth radiator extends;

the second radiating portion further comprises a seventh radiator, and an eighth radiator extending from the seventh radiator and a ninth radiator extending from the seventh radiator, and the seventh radiator extends in the direction in which the sixth radiator extends, and a second slot is formed between the seventh radiator and the sixth radiator; and the eighth radiator extends in a direction opposite to the direction in which the seventh radiator extends;

the second radiating portion further comprises a tenth radiator and an eleventh radiator that respectively extend from a side of the fourth radiator and beyond the seventh radiator and are symmetrically arranged with respect to the axis of the first radiator in the first direction, the tenth radiator and the eleventh radiator further extend in a direction opposite to the first direction and beyond the fourth radiator, and the tenth radiator and the eleventh radiator are connected to the fourth radiator and the seventh radiator, respectively; and a third slot is formed between the tenth radiator and the second radiator, and a fourth slot is formed between the eleventh radiator and the third radiator.

2. The PCB antenna as described in claim 1, wherein a width of the third slot and a width of the fourth slot both range from 1.1 mm to 1.5 mm.

3. The PCB antenna as described in claim 1, wherein operating frequency bands of the first radiator and the tenth radiator are 790 MHz-960 MHz, and operating frequency bands of the third radiator and the eighth radiator are 1710 MHz-2690 MHz.

4. The PCB antenna as described in claim 1, wherein the tenth radiator is provided with a first opening at a side close to the fifth radiator, the first opening facing towards the sixth radiator, and the eleventh radiator is provided with a second opening at a side close to the fifth radiator, the second opening facing towards the sixth radiator, and a third opening is provided at a side of the tenth radiator facing away from the seventh radiator and a fourth opening is provided at a side of the eleventh radiator facing away from the seventh radiator.

5. The PCB antenna as described in claim 4, wherein the feeder port comprises one end connected to the first radiator and the other end connected to the fifth radiator.

6. The PCB antenna as described in claim 4, wherein the feeder port is a coaxial feeder port.

7. The PCB antenna as described in claim 4, wherein the PCB substrate has a size of 124.65 mm×27.02 mm and a thickness of 0.8 mm.

8. The PCB antenna as described in claim 1, further comprising a feeder port provided in the first slot.

9. The PCB antenna as described in claim 8, wherein the feeder port is a coaxial feeder port.

10. The PCB antenna as described in claim 8, wherein the PCB substrate has a size of 124.65 mm×27.02 mm and a thickness of 0.8 mm.

11. The PCB antenna as described in claim 1, wherein a slot width of the first slot is 2.25 mm, and a dimension of the fifth radiator in a direction perpendicular to the first direction is 1 mm; widths of the first opening and the second opening are both 3 mm; and widths of the third opening and the fourth opening are both 8 mm.

12. The PCB antenna as described in claim 1, wherein a dimension of the fifth radiator in a direction perpendicular to the first direction is smaller than a dimension of the sixth radiator in the direction perpendicular to the first direction, and a dimension of the fourth radiator in the first direction is larger than a dimension of the seventh radiator in the first direction.

* * * * *